US010439300B1

(12) United States Patent
Ferderer

(10) Patent No.: US 10,439,300 B1
(45) Date of Patent: Oct. 8, 2019

(54) CONNECTION ELEMENT

(71) Applicant: HARTING Electric GmbH & Co. KG, Espelkamp (DE)

(72) Inventor: Albert Ferderer, Espelkamp (DE)

(73) Assignee: HARTING ELECTRIC GMBH & CO. KG (DE)

( * ) Notice: Subject to any disclaimer, the term of this patent is extended or adjusted under 35 U.S.C. 154(b) by 0 days.

(21) Appl. No.: 16/310,324

(22) PCT Filed: Aug. 15, 2017

(86) PCT No.: PCT/DE2017/100687
§ 371 (c)(1),
(2) Date: Dec. 14, 2018

(87) PCT Pub. No.: WO2018/036587
PCT Pub. Date: Mar. 1, 2018

(30) Foreign Application Priority Data

Aug. 22, 2016 (DE) ..... 10 2016 115 490

(51) Int. Cl.
*H01R 4/48* (2006.01)

(52) U.S. Cl.
CPC ..... *H01R 4/48* (2013.01)

(58) Field of Classification Search
CPC .. H01R 4/4818; H01R 4/4809; H01R 4/4827; H01R 4/4836; H01R 4/4845
USPC ..... 439/437–441
See application file for complete search history.

(56) References Cited

U.S. PATENT DOCUMENTS 6,132,245 A * 10/2000 Wertz ..... H01R 13/5219 439/268
6,244,904 B1 * 6/2001 Fabian ..... H01R 4/4836 439/268
6,254,422 B1 * 7/2001 Feye-Hohmann ... H01R 4/4836 439/441
6,261,120 B1 * 7/2001 Beege ..... H01R 4/4836 439/268
6,796,855 B2 * 9/2004 Fricke ..... H01R 4/4818 439/835
7,004,781 B2 * 2/2006 Walter ..... H01R 4/4836 439/268
7,438,587 B2 10/2008 Germani ..... 439/441
(Continued)

FOREIGN PATENT DOCUMENTS

DE 10257088 7/2004 ..... H01R 4/48
DE 102007009082 9/2007 ..... H01R 4/48
(Continued)

OTHER PUBLICATIONS

International Preliminary Report on Patentability issued in application No. PCT/DE2017/100687, dated Mar. 7, 2019 (9 pgs).
(Continued)

*Primary Examiner* — Ross N Gushi
(74) *Attorney, Agent, or Firm* — Hayes Soloway, P.C.

(57) ABSTRACT

Disclosed is a connection element, which includes a contact element and an actuating element and serves for mechanically and electrically contacting a conductor. The contact element has at least one contact arm, which is designed for spring-loaded clamping of a conductor on a contact surface. The connection element can be transferred into different open or closed states by a driver on the contact arm and by a guide contour in the actuating element.

22 Claims, 7 Drawing Sheets

(56) References Cited

U.S. PATENT DOCUMENTS

Figure 1A:
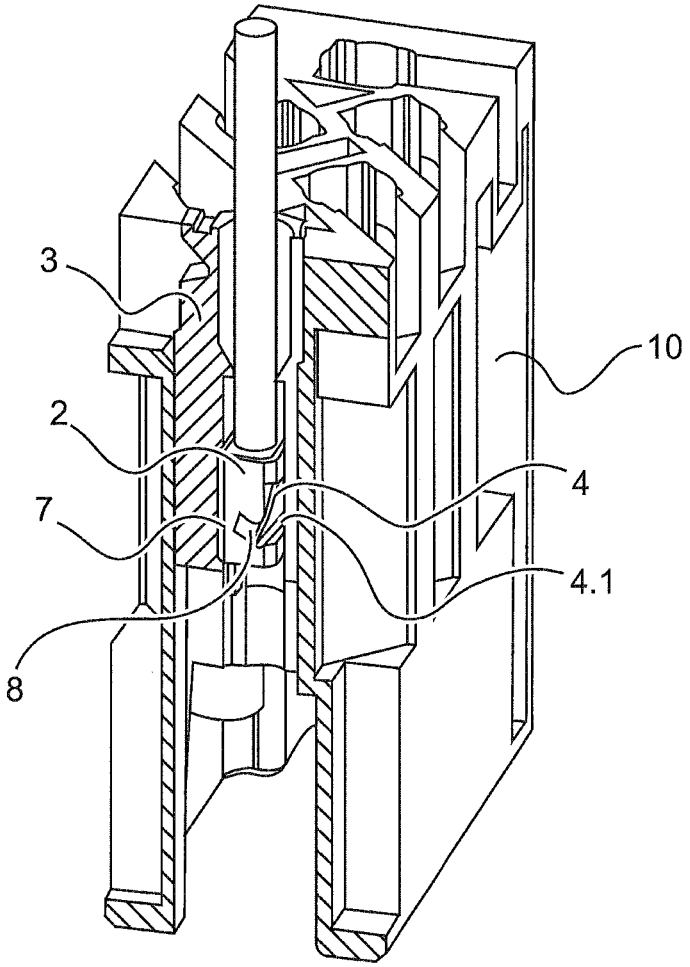

| | | | | |
|---|---|---|---|---|
| 8,177,572 | B2 | 5/2012 | Feye-Hohmann | 439/268 |
| 8,328,586 | B2 * | 12/2012 | Bies | H01R 4/4836 439/725 |
| 8,591,271 | B2 * | 11/2013 | Bies | H01R 4/4836 439/725 |
| 8,747,140 | B2 * | 6/2014 | Gassauer | H01R 13/6335 439/352 |
| 8,794,994 | B2 * | 8/2014 | Kollmann | H01R 4/4836 439/441 |
| 9,543,668 | B2 | 1/2017 | Wendt | H01R 4/5008 |
| 10,033,119 | B2 * | 7/2018 | Koellmann | H01R 4/4836 |
| 10,153,562 | B1 * | 12/2018 | Chen | H01R 4/4827 |
| 10,164,349 | B2 * | 12/2018 | Koellmann | H01R 4/4836 |
| 10,267,981 | B1 * | 4/2019 | Wu | G02B 6/0088 |
| 10,297,931 | B2 * | 5/2019 | Koellmann | H01R 4/4836 |
| 10,355,377 | B2 * | 7/2019 | Gerving | H01R 4/4827 |
| 10,367,271 | B1 * | 7/2019 | Wu | H01R 4/4836 |
| 10,367,272 | B2 * | 7/2019 | Witte | H01R 4/4836 |
| 2011/0086556 | A1 * | 4/2011 | Hollander | H01R 4/4836 439/733.1 |
| 2011/0207361 | A1 | 8/2011 | Heckert et al. | 439/350 |
| 2011/0207372 | A1 * | 8/2011 | Breen, IV | H01R 4/4836 439/629 |
| 2019/0109395 | A1 * | 4/2019 | Geske | H01R 13/11 |
| 2019/0229441 | A1 * | 7/2019 | Koellmann | H01R 4/4836 |

FOREIGN PATENT DOCUMENTS

| | | | |
|---|---|---|---|
| DE | 102008032837 | 1/2010 | H01R 13/42 |
| DE | 202008014469 | 3/2010 | H01R 4/48 |
| DE | 202011050916 | 11/2012 | H01R 4/48 |
| DE | 102013108116 | 2/2015 | H01R 4/48 |
| EP | 0365888 | 5/1990 | H01R 9/07 |

OTHER PUBLICATIONS

German Office Action issued in application No. 10 2016 115 490.3, dated Jun. 6, 2017 (12 pgs).

International Search Report (w/translation) and Written Opinion (no translation) issued in application No. PCT/DE2017/100687, dated Oct. 12, 2017 (12 pgs).

* cited by examiner

CONNECTION ELEMENT

DESCRIPTION

The invention is based on a connection element that has a contact element and an actuating element, and that serves for mechanically and electrically contacting a conductor.

Such connection elements are required in order preferably to mechanically and electrically contact electrical stranded wires or conductors. In this case, individual stranded conductors or solid conductors of a cable are to be connected to a device, a plug-and-socket connector, a circuit or other items of electrical equipment.

The connection element in this case is the connection member between the conductor or the stranded wire and a further electrical contact of the device, the plug-and-socket connector or the other item of electrical equipment. The connection element offers reversible contacting that on the one hand provides an electrical connection between the conductor and the item of equipment, in order to transmit signals and electric current, but the connection element also ensures the mechanical connection of the conductor to the device. Such connection elements have long been known from the prior art as alternatives to irreversible connections. Thus, without such reversible connection elements, a lead would necessarily have to be soldered or crimped. In both cases, it would not be possible to release the conductor or stranded wire without a relatively large amount of mechanical or thermal input.

PRIOR ART

DE 10 2007 009 082 C5 shows a multi-pole electrical plug-and-socket connector having a spring contact wherein, for each conductor that is to be connected to the plug-and-socket connector, a first opening is provided, which is designed to receive the conductor. A second opening, which runs parallel to the first opening, is in this case designed to receive an actuating pin, which—by sliding in the second opening—acts, according to its position, upon a spring contact of the plug-and-socket connector, in order to lock the conductor to the plug-and-socket connector or to release it from the plug-and-socket connector. Releasing of the conductor from the spring contact is effected by means of a tool that serves to lever up the actuating pin.

An electrical connection terminal and the associated method is known from DE 10 2013 108 116 A1. The connection terminal serves to contact an electrical conductor to a busbar accommodated in a receiver. For this purpose, the connection terminal has a slotted guide, comprising a closing slot and a clamping slot, and an actuating lever that is guided in the slotted guide. The connection terminal is represented as a type of rocker-arm terminal. It is disadvantageous in this case that the connection of the conductor is effected in two steps.

DE 20 2011 050 916 U1 discloses a housing, in particular a connection terminal or the like, having a contour-guided actuating element. This is a two-part housing, having a control contour and a mating contour, the control contour being fastened to a housing part and the mating contour to an actuating limb. In this case, the actuating limb can be moved three-dimensionally, but this has the disadvantage of causing greater wear.

A connection terminal for connecting conductor ends is known from DE 20 2008 014 469 U1. The connection terminal has a control-contour guided actuating element that enables a clamping spring to be latched in an open position to facilitate insertion of an electrical conductor. In this case, the actuating element is simultaneously defined as a conductor leadthrough opening.

EP 0 365 888 A1 discloses an electrical connector for flat, flexible conductors. The contacting of the electrical conductors in this case is effected by means of a multi-arm actuating means that can be inserted into the housing of the electrical conductor. This enables a plurality of electrical conductors to be contacted simultaneously, but prevents individual contacting. In addition, contacting of differing conductors is precluded, with the result that the electrical connector has only a special field of application.

A disadvantage of the solutions known from the prior art is that, in these solutions, mostly only one actuating operation—opening or closing—is configured to be convenient for the user. For the operator or fitter of a cable, it is always ergonomically expedient to execute a linear motion, by means of a tool, or advantageously entirely without a tool, using only the bare hands. Thus, for example, the pressing of an actuator. By contrast, more complex motion sequences, such as levering by means of a screwdriver or other tool, are considered to be awkward and laborious.

Moreover, for initial fitting of a conductor, simple and rapid installation is advantageous. In the case of the installation of a multiplicity of conductors on a system, it is desirable for the operator not to have to do a lot of preparation, but to be able to connect the multiplicity of conductors or stranded wires directly, ideally without the use of a tool.

This is not possible with the solutions known from the prior art. Either the connection elements enable the user to effect a rapid initial fitting of leads, but are then awkward to manipulate in the case of subsequent removal and reconnection. Or an initial connection of conductors requires a certain amount of preparation work by the user, which makes rapid fitting of a plurality of conductors or stranded wires impossible.

STATEMENT OF OBJECT

The invention is therefore based on the object of presenting a connection element that is suitable both for stranded conductors and for solid conductors. The connection element is intended to enable the operator to effect an initial installation that is as simple, rapid and force-free as possible. Moreover, the connection element is intended to be operable as easily and rapidly as possible in the case of a subsequent de-installation and re-installation, without the need for a special tool, or without this requiring complicated actions by the operator.

The object is achieved by the characterizing features of the independent claim 1.

Advantageous designs of the invention are specified in the dependent claims.

The invention is a connection element that is composed of a contact element and an actuating element. The contact element is preferably realized as an electrical contact element, and is designed for electrically and mechanically contacting an electrical stranded or solid conductor.

The connection element is expediently incorporated in an insulation body of an electrical device, a plug-and-socket connector, an electric circuit or other electrical system that has to be connected to one or more electrical conductors or cores. The connection element may thus be realized as part of such an item of equipment, and used for directly connecting conductors or cores to the item of equipment.

For the purpose of electrically and mechanically contacting a conductor to be contacted, a movable contact arm is provided on the contact element. Depending on the embodiment, this contact arm may be realized as a separate component part that is movably connected to the contact element, or integrally with the contact arm. The preferred, integral, embodiment of the contact arm with the contact element renders possible inexpensive production by a stamping and bending process.

Thus, in a preferred embodiment, the contact element has a clamping region, which is formed between the contact arm and a contact surface of the contact element. A conductor, which is pressed onto the contact surface by the contact arm, can be inserted into the clamping region. For this purpose, the contact arm is realized such that it is pressed under preload onto the contact surface.

For this purpose, the contact arm forms a free end and a fixed end. The fixed end forms the transition to the rest of the contact element and is designed so as to be mechanically flexible, such that the free end of the contact arm is movable. The free end can thus be bent away from the contact surface. The spring force that is generated in the fixed end upon the elastic deformation springs the free end of the contact arm back again automatically, and is pressed against the contact surface.

The thus produced direction of movement of the contact arm forms an open position, in which the free end of the contact arm is deflected contrary to the spring force, and a closed position, in which the free end of the contact arm is pressed by the spring force onto the contact surface.

According to the invention, the actuating element and the connection element are movable relative to each other. An advantageous embodiment in this case provides that the contact element is fixedly connected to an insulation body, in which the connection element is accommodated. The actuating element is arranged so as to be movable, preferably linearly movable, in the insulation body.

A particular embodiment provides that the actuating element is realized in the form of a sleeve. This means that the actuating element has a basic elongate shape, which has a continuous opening along the length. In this embodiment, the contact element is arranged in the continuous opening of the actuating element. The actuating element thus surrounds the contact element on four sides. This embodiment renders possible a particularly space-saving design of the connection element.

According to the invention, there is a guide contour realized on the actuating element. A driver, which corresponds to the guide contour, is realized at the free end of the contact arm of the contact element. As a result of the driver being guided in the guide contour, the deflection and movement of the contact arm can be determined in dependence on the relative position of the actuating element and the contact element in relation to each other. This design of the connection element according to the invention makes it possible to control the position of the contact arm (open or closed) by movement of the actuating element.

A preferred embodiment provides that the driver is realized as a pin or bolt that is oriented transversely in relation to the direction of movement of the contact arm. The guide contour in this case is realized as a groove in the actuating element. The driver, realized as a pin or bolt, can thus slide along in the guide groove when the actuating element is moved relative to the contact element.

One embodiment of the connection element provides that the free end of the contact arm executes a sectorial movement about the fixed end of the contact arm. As a result, the direction of movement of the contact arm likewise describes a circular path, or at least a sectorial path, on which the contact arm moves.

According to the invention, the guide contour in the actuating element describes at least two regions, in which the driver of the contact element is guided. A first region, in which the driver is held in the open position of the contact arm. For this purpose, the first region is realized as a step that is oriented transversely in relation to the direction of movement of the contact arm. In this case, the spring force of the contact arm presses the latter onto the step of the first region. A particularly preferred embodiment of the first region provides that the step is provided with a recess. The driver can thus be accommodated in the recess, and as a result the actuating element can latch-in in this open position. A movement of the actuating element can thus not be effected unintentionally.

Nevertheless, only a slight expenditure of force is required to move the driver out of the recess, contrary to the spring force, by movement of the actuating element.

The second region of the guide contour is realized such that, in this region, the driver can be moved in a freely movable manner between the open position and the closed position. The second region is realized in the shape of a sector, the shape corresponding to the direction of movement and to the course of movement of the contact arm and/or of the driver. In this region, the contact arm will always assume the closed position, into which it is forced by the spring force of the contact element.

According to the invention, the second region directly adjoins the first region of the guide contour. The connection element can thus be supplied in an open position, in which the actuating element is arranged such that the driver is located in the first region of the guide contour. As a result of a brief, slight movement of the actuating element, the driver slides into the second region of the guide contour, and can move freely, along the sectorial guide, into the closed position.

A particular embodiment of the invention provides that the guide contour has a third region. The third region is realized as a ramp, and guides the contact arm from the closed position to the open position upon the actuating element being moved by the length of the third region. In this case, the end of the ramp that describes the closed position coincides with the second region. The third region is thus provided on the side of the second region that faces away from the first region.

As a result of the actuating element being realized with a first, a second and a third region, the connection element can assume three states:

A first state which, as a distribution state, is defined by the first region of the guide contour. In the first region the driver lies on the step, as a result of which the connection element is in an open position. Owing to the step, which is oriented transversely in relation to the direction of movement of the contact arm, the first state is static.

A second state, which is defined by the second region of the guide contour. In this state, the contact arm can move freely from the open position to the closed position, and back. The spring force acting upon the contact arm always causes the latter to go as far as possible into the closed position, and thus to clamp an inserted conductor or a stranded wire between the contact arm and the contact surface. Owing to the free movement of the contact arm, and the spring force acting upon the latter, the second state is likewise static.

The third state is defined by the ramp in the third region of the guide contour. As a result of movement of the actuating element, the contact arm is moved, by means of the driver, via the ramp, from the closed position into the open position. However, this only occurs for as long as there is a force acting upon the actuating element. As soon as this force is removed, the actuating element is pressed back again, by means of the spring force of the contact arm, the driver and the ramp, into the second state. The third state is thus dynamic.

A particular embodiment provides that the guide contour is realized a further, fourth, region. In this case the fourth region, in a manner similar to the first region, is realized as a step that is oriented transversely in relation to the direction of movement. In this case, in the open position, the fourth region adjoins the third region. The actuating element, in a maximally open position in the third state, can thus be moved further, until the driver slides into the fourth region. The fourth region, exactly like the first region, thus defines a static, fourth, state. The step in the fourth region may also be modified by a recess, such that the actuating element is secured against being inadvertently moved into the third region.

A further, special embodiment of the invention provides a fifth region of the guide contour. The fifth region in this case is arranged on the first region, facing away from the second region. The fifth region in this case corresponds in its shape to the third region, and is realized as a ramp. When the connection element is being assembled, the driver can be guided, by means of this ramp, from the closed position, in which it is subjected to force, into the open position. As a result of the actuating element being slid onto the contact element, the contact arm is thus opened, by means of the ramp, until the driver lies in the first region of the guide contour, and the first, open, state of the connection element is established.

A particularly preferred embodiment of the invention provides that the guide contour is realized only by the first and second region. In this case, the second region is not realized in the form of a sector, but in the form of a ramp. As a result, the connection element can be both closed and opened again by means of the second region of the guide contour. For this purpose, it is necessary only for the actuating element to be moved contrary to the second region, such that the driver goes back into the first region.

Owing to the combination, according to the invention, of the driver on the contact arm and the guide contour in the actuating element, states of the connection element can be defined in a particularly advantageous manner. It is thereby possible to define a distribution state that is advantageous for the operator, rendering possible rapid assembly of a large number of connection elements. Nevertheless, simple and rapid disassembly is possible, without special tools. All objects on which the invention is based are thus achieved in a particularly advantageous manner.

EXEMPLARY EMBODIMENT

Figure 2A:
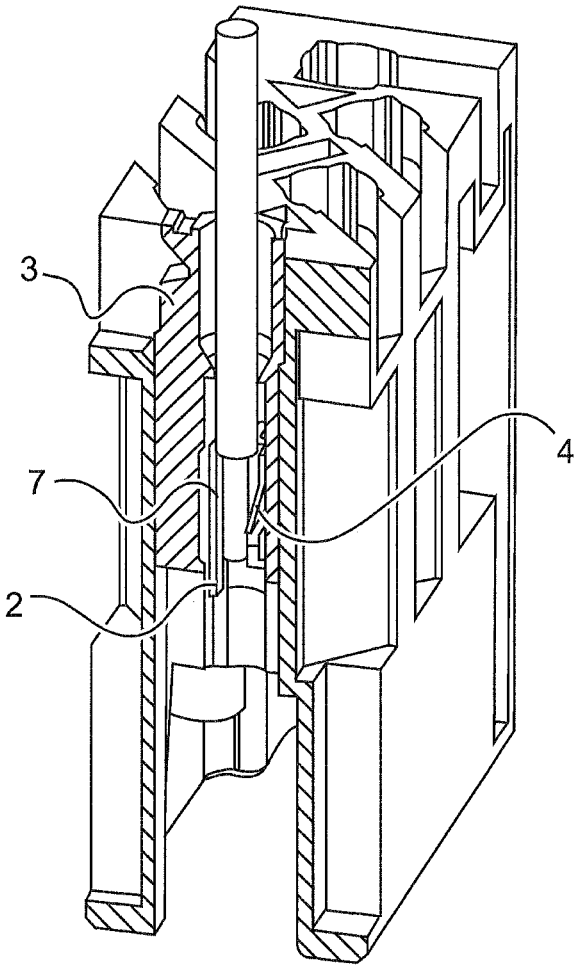
Figure 3A:
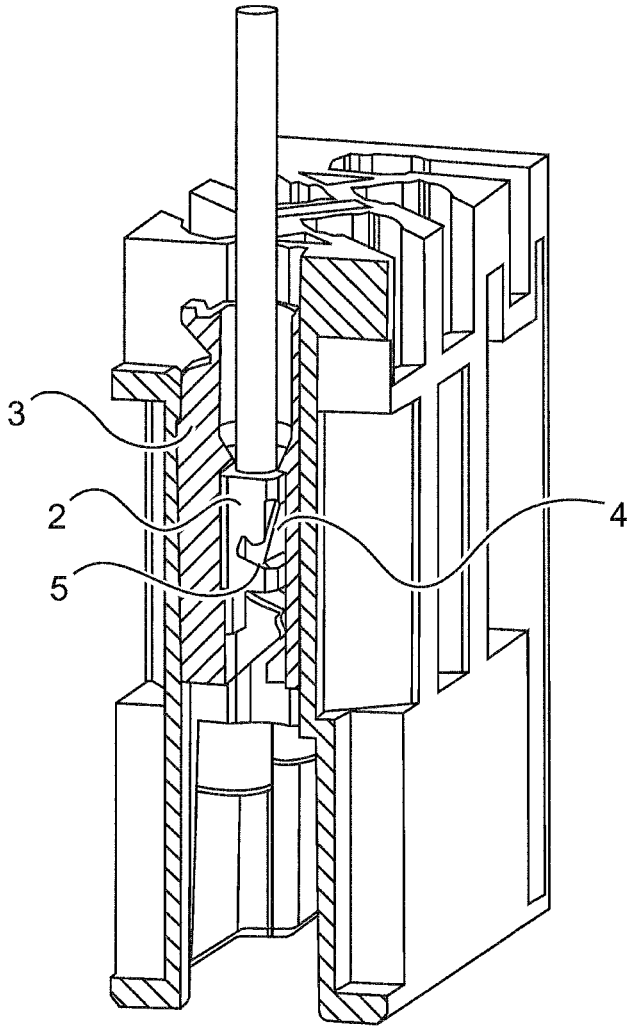
Figure 4:
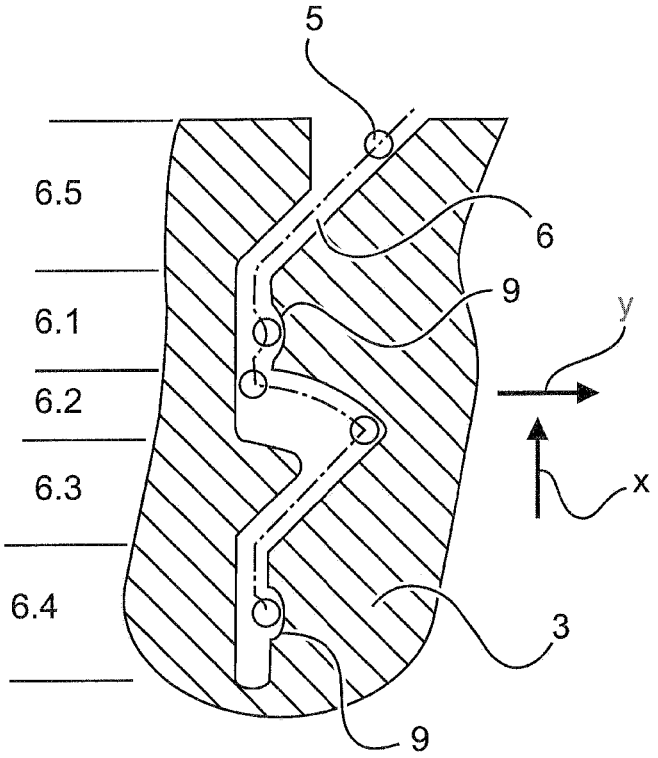

An exemplary embodiment of the invention is represented in the drawings, and is explained in greater detail in the following. There are shown:

FIG. 1*a,b* a connection element in a first state, in a perspective representation, and a sectional representation;

FIG. 2*a,b* a connection element in a second state, in a perspective representation, and a sectional representation;

FIG. 3*a,b* a connection element in a third state, in a perspective representation, and a sectional representation; and FIG. 4 a guide contour.

The figures contain partly simplified, schematic representations. In some cases identical references are used for elements that are similar, but possibly not identical. Different views of the same elements may differ in scale.

Figure 1B:
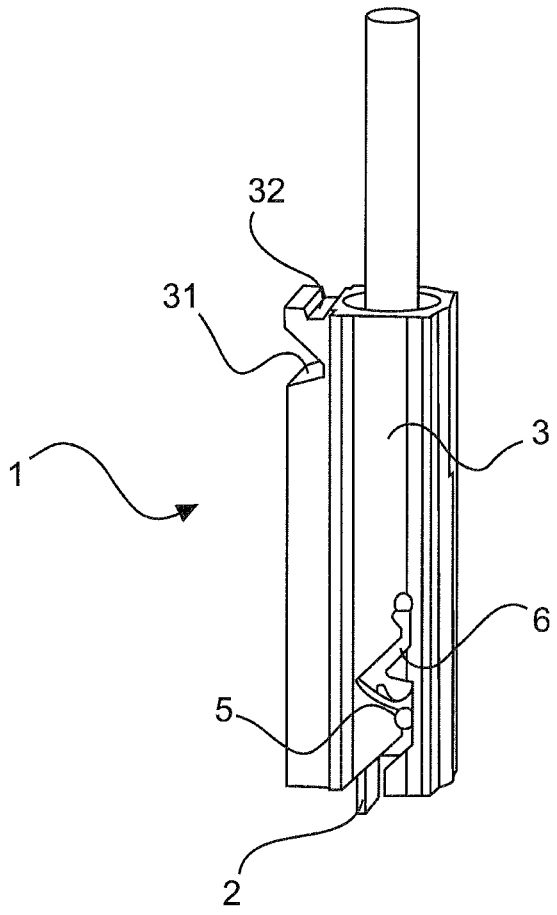

FIG. 1 shows a connection element 1 according to the present invention in a perspective representation (FIG. 1*b*) and a sectional representation (FIG. 1*a*), the connection element 1 in FIG. 1*a* being arranged in an insulation body 10.

The connection element 1 is composed of a sleeve-type actuating element 3 and a contact element 2 accommodated therein. The actuating element 3 is elongate, and has a substantially rectangular basic shape. An opening extends lengthwise through the basic shape. The contact element 2 is arranged in the opening. Represented in the upper region of the actuating element 3 is an electrical cable, which is inserted into the connection element 1 for the purpose of contacting. The opening of the actuating element 3 thus also serves as a conductor receiving opening of the connection element 1.

Formed into the actuating element 3, in the upper region of the actuating element 3, are two actuation cavities 3.1, 3.2. The latter are provided in addition for actuation of the actuating element 3. At the actuation cavities 3.1, 3.2, the actuating element 3 can be pressed from above or levered from the side, for example by means of a screwdriver, in order to move it further into or out from the insulation body 10.

Unlike the actuating element 3, the contact element 2 is not accommodated in a movable manner in the insulation body 10. The contact element 2 is fastened in a fixed manner in the insulation body 10. A relative movement between the actuating element 3 and the contact element 2 is thus possible.

The contact element 2 forms a contact surface 7 and, opposite the contact surface 7, a contact arm 4. The contact arm 4 is integrally formed, so as to be flexible, on the contact element 2. The spring stiffness, and thus the contact force with which the contact arm 4 is pressed in the direction of the contact surface 7, is defined by the material property of the contact element 2. Formed between the contact arm 4 and the contact surface 7 is a clamping region 8, which serves to clamp and contact the inserted cable. A free core end of the cable can thus be clamped, and mechanically and electrically contacted, between the contact arm 4 and the contact surface.

The contact arm 4 describes a fixed end and a free end 4.1. The fixed end is the region at which the contact arm 4 is held on the contact element 2 and integrally connected to the latter. The free end 4.1, which can spring freely in the direction of the contact surface 7, is equipped with two drivers 5. The drivers 5 of the contact arm 4 are provided laterally, and engage in the actuating element 3. Formed in the actuating element 3 are corresponding guide contours 6, in which the drivers 5 engage. The guide contours 6 are let into the actuating element 3 identically on two sides.

Depending on a relative position of the contact element 2 and the actuating element 3 in relation to each other, the drivers 5 are located in a different region of the guide contours 6. Accordingly, the free end 4.1 of the contact arm 4 is oriented according to position. An open position, and also a closed position, of the contact arm 4 can thus be set. Also provided is a position of the contact element 2 and the actuating element 3 in relation to each other in which the drivers 5 can be moved freely. In this position (see FIG. 2), the position of the contact arm 4 can be flexibly adjusted to the thickness of an inserted cable.

The first state, represented in FIG. 1, defines the distribution state of the connection element 1. In this position, the connection element 1 is open as far as is possible. The contact arm 4 is maximally deflected. The drivers 5 lie in a first region 6.1 of the guide contours 6.

Figure 2B:
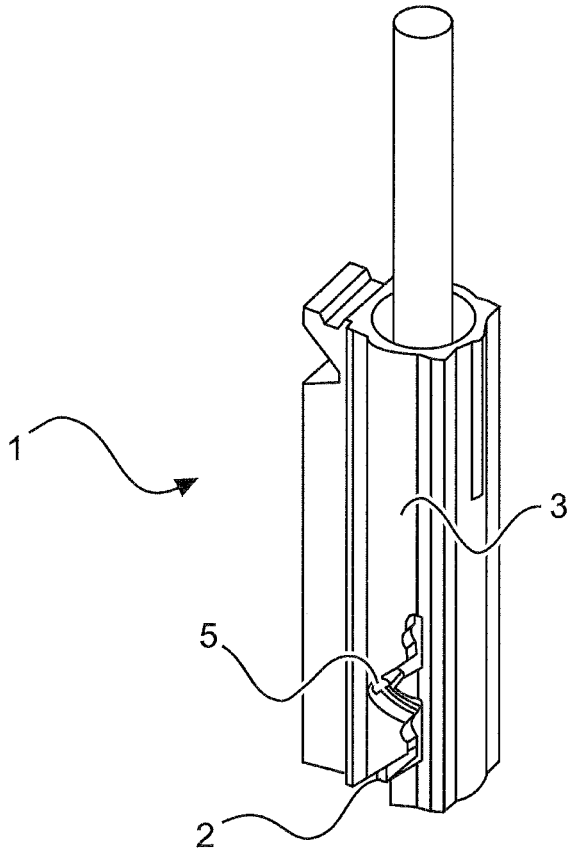

FIG. 2 shows the connection element 2 from FIG. 1 in a second state. In the closed state shown, the actuating element 3 has been pushed further into the insulation body 10. As a result, the drivers 5 have slid into a second region 6.2 of the guide contours 6. In the second region 6.2 of the guide contours 6, the drivers 5 can move freely along the direction of movement of the contact arm 4. As a result, the contact arm 4 can adopt any position in a freely movable manner and thus, by its spring force, clamp an inserted conductor.

Figure 3B:
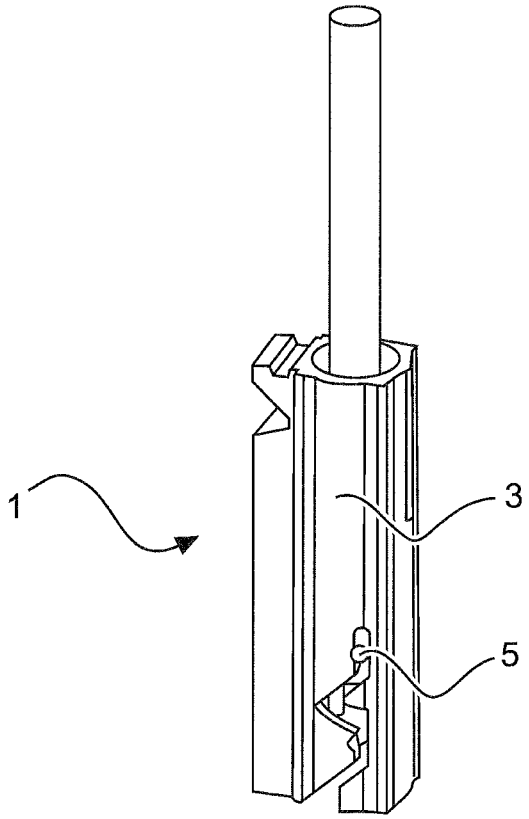

In FIG. 3 the connection element 2 is represented in a fourth state. In this state the connection element 2 is open, in a manner identical to the first state. However, the actuating element 3 has been inserted yet further into the insulation body 10, as a result of which the drivers 5 lie in a fourth region 6.4 of the guide contours 6. This fourth state is particularly advantageous, since the actuating element 3 can be actuated by a simple pressing motion in order to open the connection element 2 again. The actuating element 3 does not have to be drawn awkwardly out of the insulation body 10. The user or operator, by the same simple pressing motion, can thus connect an electrical conductor (first state-second state) and release it again (second state-fourth state).

In order to bring the connection element 1 from the second state into the fourth state, a third state is required. The third state in this case describes the movement of the actuating element 3 by which the drivers 5 are moved, via a third region 6.3 of the guide contours 6, into the fourth region 6.4. The third region 6.3 of the guide contours 6 in this case is realized as a ramp, which connects the second region 6.2 to the fourth region 6.4. Via this ramp, the contact arm 4 is moved, contrary to the spring force, into the open position, which it also assumes in the first state.

The guide contours 6 have a recess 9 in the first region 6.1 and in the fourth region 6.4, respectively. The recesses 9 are designed such that the drivers can be accommodated in them, but do not latch in a fixed manner therein. This means that, as a result of displacement of the actuating element 3, the drivers are lifted out of the recesses 9 and can slide into another region. The recesses 9 in this case serve merely to adjust the first state and the fourth state. Owing to the recesses 9 and the drivers 5 accommodated therein, the actuating element 3 cannot be inadvertently moved with a very slight expenditure of force. The user or operator must at least expend a conscious, slight force in order to influence the state of the connection element 1.

A guide contour 6 is represented in detail in FIG. 4. In the indicated actuating element 3 (hatched lines), the guide contour 6 is formed as a groove or slot. As a result of a relative displacement of the actuating element 3 in relation to the contact element 2 along the x direction, the schematically represented driver 5 executes a movement along the guide contour 6. In this case, a permanent force is exerted upon the driver 5 in the y direction.

The fifth region 6.5 is provided merely for assembly purposes. In this fifth region 6.5, the driver can be moved via a ramp into the initial position of the first state, into the first region 6.1.

The first region 6.1 represents the first state, the distribution state. In this first region 6.1, the contact arm 4 is maximally deflected, and the connection element 1 is thus open.

The second region 6.2 forms the second, closed state of the connection element 1. Here, the contact arm 4 can freely execute a sectorial movement about its fixed end. In the second region 6.2, the guide contour 6 is realized so as to be identical to the sectorial movement of the contact arm 4. It is not possible for the connection element 1 to be brought from the second state into the first state by displacement of the actuating element 3.

The third region 6.3 forms a ramp identical to the fifth region 6.5. The connection element 1 can be opened again via this ramp of the third region 6.3, in that the driver 5 is brought, via the ramp, into a position of maximum deflection of the contact arm 4. Owing to the force acting continuously upon the driver 5 in the y direction, in this third region 6.3 the connection element 1 always re-assumes the closed position of the second state.

The fourth region 6.4, as an optional region, adjoins the third region. In this fourth region 6.4, the connection element 1 can remain fixed in a fourth, open state, identical to the first state. In order for the connection element 1 to be closed again, the actuating element 3 only has to be displaced a short distance contrary to the x direction until the driver 5 is again located in the third region 6.3 of the guide contour and, as a result of the spring force acting upon it, automatically forces the connection element 1 into the second, closed state.

LIST OF REFERENCES

1 connection element
2 contact element
3 actuating element
3.1 actuation cavity
3.2 actuation cavity
4 contact arm
4.1 free end
4.2 fixed end
5 driver
6 guide contour
6.1 first region
6.2 second region
6.3 third region
6.4 fourth region
6.5 fifth region
7 contact surface
8 clamping region
9 recess
10 insulation body

The invention claimed is:

1. A connection element, which has a contact element and an actuating element, wherein the contact element has a movable contact arm that can be moved, between a closed position and an open position, wherein the contact arm has at least one driver, which is oriented at the free end of the contact arm, wherein the actuating element can be moved relative to the contact element and has a guide contour, which is formed as a groove or slot in the actuating element, and wherein the driver of the contact element is arranged in the guide contour and can be guided in it.

2. The connection element as claimed in claim 1, wherein the contact arm has a free end and a fixed end, wherein the direction of movement of the contact arm defines a sectorial movement of the free end about the fixed end.

3. The connection element as claimed in claim 1, wherein the at least one driver is oriented transversely in relation to the direction of movement of the contact arm.

4. The connection element as claimed in claim 1, wherein the contact element has a contact surface, wherein a clamping region is realized between the contact surface and the contact arm.

5. The connection element as claimed in claim 4, wherein the free end of the contact arm in the closed position is arranged closer to the contact surface than in the open position.

6. The connection element as claimed in claim 1, wherein the contact arm is integrated with the contact element and is oriented resiliently in the closed position.

7. The connection element as claimed in claim 1, wherein the actuating element is realized as a sleeve, and the contact element is arranged, at least in regions, in the actuating element.

8. The connection element as claimed in claim 1, wherein the guide contour of the actuating element has at least one first region and one second region, wherein the driver is arranged in one of the regions of the guide contour, depending on the position of the contact element and actuating element in relation to each other.

9. The connection element as claimed in claim 8, wherein in the first region of the guide contour, the driver and the free end of the contact arm are oriented in the open position, and that, in the second region of the guide contour, the driver and the free end can be moved freely between the open position and the closed position.

10. The connection element as claimed in claim 9, wherein the first region of the guide contour is realized as a step, transversely in relation to the direction of movement of the contact arm.

11. The connection element as claimed in claim 10, wherein the first region of the guide contour has a recess in the direction of movement of the contact arm.

12. The connection element as claimed in claim 8, wherein the second region of the guide contour extends along the direction of movement of the contact arm.

13. The connection element as claimed in claim 12, wherein the second region of the guide contour is realized in the form of a sector.

14. The connection element as claimed in claim 8, wherein the guide contour has a third region, wherein the third region is realized as a ramp.

15. The connection element as claimed in claim 14, wherein at a first end, the ramp of the third region orients the driver and the free end of the contact arm in the closed position, and that, at a second end, the ramp of the third region orients the driver and the free end of the contact arm in the open position.

16. The connection element as claimed in claim 15, wherein the second region of the guide contour is arranged between the first region and the third region.

17. The connection element as claimed in claim 8, wherein the guide contour has a fourth region, wherein the fourth region is realized as a step, transversely in relation to the direction of movement of the contact arm.

18. The connection element as claimed in claim 17, wherein the fourth region of the guide contour has a recess in the direction of movement of the contact arm.

19. The connection element as claimed in claim 17, wherein the fourth region adjoins the second end of the third region of the guide contour.

20. The connection element as claimed in claim 18, wherein the fourth region adjoins the second end of the third region of the guide contour.

21. The connection element as claimed in claim 8, wherein the guide contour has a fifth region, wherein the fifth region is realized as a ramp.

22. The connection element as claimed in claim 21, wherein at a first end, the ramp of the fifth region orients the driver and the free end of the contact arm in the closed position, and in that, at a second end, the ramp of the fifth region orients the driver and the free end of the contact arm in the open position and graduates into the first region.

* * * * *